United States Patent [19]

Winkle

[11] Patent Number: 4,678,230

[45] Date of Patent: Jul. 7, 1987

[54] BACK SUPPORT MEANS

[76] Inventor: Graeme J. Winkle, 395 Brisbane Corso, Yeronga, 4104, Brisbane, Queensland, Australia

[21] Appl. No.: 760,746

[22] PCT Filed: Oct. 10, 1984

[86] PCT No.: PCT/AU84/00197

§ 371 Date: Jun. 28, 1985

§ 102(e) Date: Jun. 28, 1985

[87] PCT Pub. No.: WO85/01644

PCT Pub. Date: Apr. 25, 1985

[30] Foreign Application Priority Data

Oct. 14, 1983 [AU] Australia ..... PG1842

[51] Int. Cl.[4] ..... A47C 3/00

[52] U.S. Cl. ..... 297/284

[58] Field of Search ..... 297/284, 460; 248/421; 74/89.15

[56] References Cited

U.S. PATENT DOCUMENTS

| | | | |
|---|---|---|---|
| 2,358,319 | 9/1944 | Dupee | 248/421 X |
| 2,920,871 | 1/1960 | Kolodin | 74/89.15 |
| 3,547,486 | 12/1970 | Herzer et al. | 297/408 |
| 4,019,777 | 4/1977 | Hayashi . | |
| 4,072,287 | 2/1978 | Swenson et al. | 248/421 |
| 4,148,522 | 4/1979 | Sakurada et al. . | |
| 4,155,592 | 5/1979 | Tsuda et al. . | |
| 4,162,807 | 7/1979 | Yoshimura . | |
| 4,182,533 | 1/1980 | Arndt et al. . | |
| 4,295,681 | 10/1981 | Gregory | 297/284 |
| 4,313,637 | 2/1982 | Barley . | |
| 4,339,150 | 7/1982 | McNamara et al. | 297/284 |

FOREIGN PATENT DOCUMENTS

| | | | |
|---|---|---|---|
| 1126148 | 6/1982 | Canada . | |
| 2541559 | 3/1977 | Fed. Rep. of Germany | 297/284 |

*Primary Examiner*—Francis K. Zugel

*Attorney, Agent, or Firm*—Renner, Otto, Boisselle & Lyon

[57] ABSTRACT

A back support mechanism (10) for a chair (9). The mechanism (10) has a pad (16) pivotally mounted to two links (17,18). An operating shaft (24) screw threadedly engages posts (19) mounted relative to guide rails (20). The links (17) cooperate with the posts whereby when the shaft (24) is rotated the posts (19) are caused to move along rails (20). This movement enables the pad (16) to pivot relative to the links (17) to cause the pad (16) to move out of the plane of the backrest (12) of the chair (9).

8 Claims, 7 Drawing Figures

BACK SUPPORT MEANS

The invention relates to back support mechanisms.

Mass produced chairs and the like formed with a fixed back support structure do not provide adequate lumbar support for many users. Various attempts have been made using selective padding of back rest zones in order to provide comfort together with adequate lumbar support for a variety of users. Of course individual requirements vary to a date such attempts have not been entirely successful. Also back rests have been formed on adjustable mountings to vary the inclination thereof. However, such adjustment cannot accommodate variations in individual back configurations.

The present invention aims to alleviate the disadvantages associated with such prior art devices and to provide a back support mechanism which can be incorporated in backrests and which will be effective and efficient in use. It is also an object of this invention to provide such a mechanism which can be adjusted to suit individual requirements.

With the foregoing and other objects in view, this invention provides a back support mechanism for a backrest of a chair including:

operating means;

adjustable support means mounted to the operating means;

control means for actuating said operating means to move said support means out of the plane of the backrest for a chosen degree.

Preferably the adjustable support means bearing pad is movable in a direction substantially at right angles to the plane of the backrest. If desired however, the bearing pad could be movable or pivotal for adjustment in any suitable manner so as to provide support in the lumbar region of a user. In a preferred form the bearing pad is centrally disposed and pivotally connected to the opposed supports arranged for movement towards or away from one another and the pivotal connection being such that such movement causes a corresponding movement of the bearing pad substantially in the direction at right angles to the plane of movement of said supports. The supports can be adapted to move transversely or in an up and down direction and of course if desired the bearing pad could be coupled to a single support or it could be located by other actuating mechanisms. Preferably the supports engage a threaded actuating shaft having external actuating means whereby rotation of the shaft will cause the supports to move together or away from one another.

The invention will now be described by way of example with reference to the accompanying drawings in which.

Figure 1:
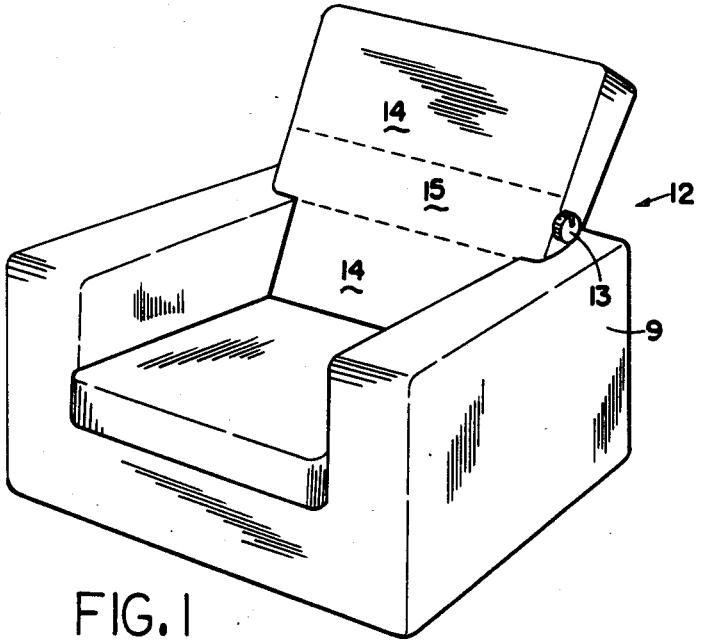
FIG. 1 is a perspective view illustrating a typical application of the present invention.

As illustrated the support mechanism 10 is adapted to be supported between the side rails 11 of the backrest 12 of a chair. The side rails 11 are upholstered and control means such as an operating knob 13 is supported in an accessible position projecting outwardly from the backrest as illustrated in FIG. 1. The backrest 12 may include fixed upper and lower backrest panels 14 and an intermediate backrest panel 15 which is separately upholstered and movable with respect to the adjacent panels 14 such that adjustment of the panel 15 will not pull on the fixed upholstery fabric in the panels 14 and about the side rails 11 and cause creases and the like to form in the upholstery fabric.

The back support mechanism 10 includes adjustable support means comprising a central substantially rectangular bearing pad 16 which is connected pivotally at opposite sides to laterally spaced link members 17 each having upper and lower slotted arms 18 remote from the pad 16 which engage about mountings or posts 19. Posts 19 are supported slidably on upper and lower guide rails 20. The inner end portions 21 of the link members 17 extend inwardly beyond their pivotal connections 23 with the bearing pad 16 and are formed with meshing projections 25.

The control means further includes a threaded shaft 24 having opposite hand threads at the respective end portions thereof extends between the side rails 11 and engages threadedly with the respective central portions of the posts 19 such that upon rotation of shaft 24 the posts are both simultaneously moved either towards or away from one another, depending upon the direction of rotation of the shaft 24 along the supporting rods 20. A control knob 13 is provided for rotating shaft 24.

In use, the back support mechanism is provided with suitable padding and is encased within suitable upholstery forming the intermediate section 15.

Figure 2:
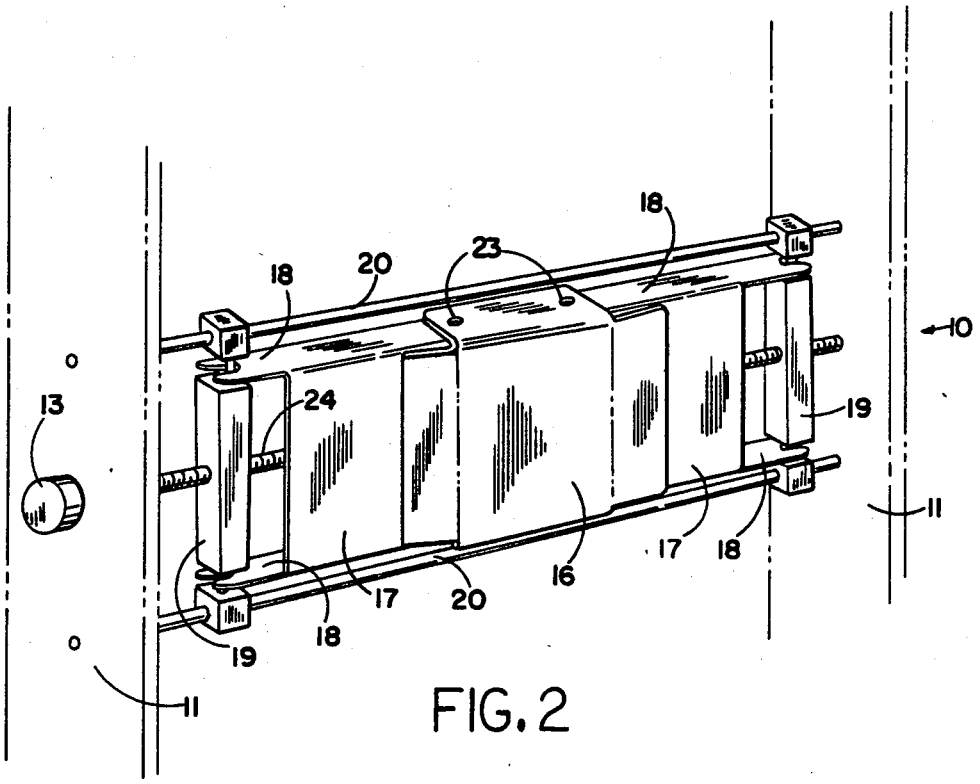
FIG. 2 is a perspective view of a preferred form of back support mechanism.
Figure 3:
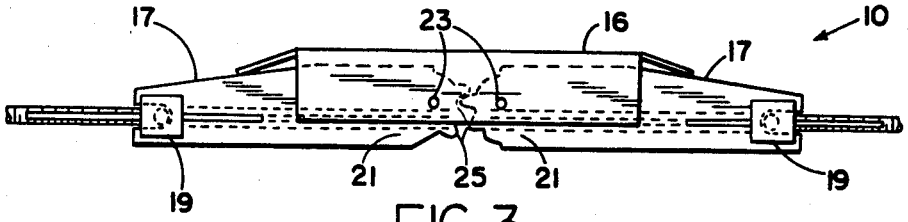
FIG. 3 is a plan view of the mechanism illustrated in FIG. 2.
Figure 4:
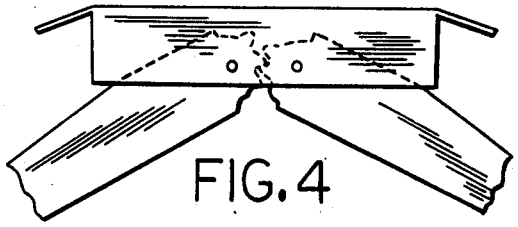
FIG. 4 is a broken away view illustrating the operation of the back support mechanism.

A user supported in the chair 9 can by rotation of the knob 13 move the bearing pad 16 forwards or rearwards to provide the desired amount of support at the lumbar region. When the control knob is rotated in one direction the mounting posts 19 will move towards one another to cause the links 17 to pivot outwardly and carry the bearing pad 16 outwardly with their inner ends to an outer position as illustrated in FIG. 4. Since both parts will move a corresponding amount the outer face of the bearing pad 16 is maintained in a parallel relationship with the supporting plane of the backrest 12. If the knob 13 is rotated in the opposite direction the posts 19 will move apart enabling the links to retract towards the position illustrated in FIG. 2.

If desired return springs can be provided to cause retraction of the links 17, or the end parts on the slotted arms 19 could be adapted to encircle the respective post such that the links 17 would be drawn to their retracted position. Alternatively the upholstery tension or the weight of a user may be used to cause retraction of the bearing pad 16. In the illustrated embodiment the meshing of the teeth 25 between the inner ends of the links 17 will ensure even retraction thereof.

Figure 5:
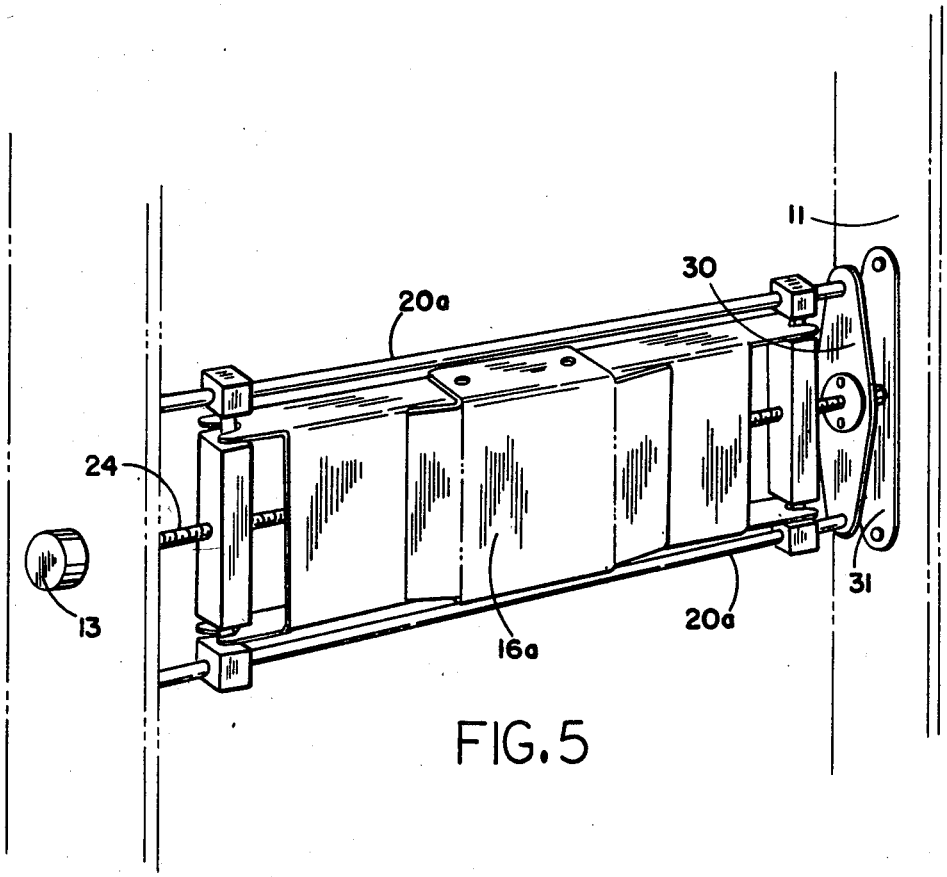
FIG. 5 illustrates a modified mounting arrangement for the support mechanism.

FIG. 5 illustrates a modified mounting for the guide rails **20*a* whereby the bearing pad 16*a* can be tilted about an axis coincident with the shaft 24. In this embodiment the ends of the guide rails 20*a* are located in sockets in respective side brackets 30 connected pivotally to a mounting plate 31 screwed to the inside face of the respective side rails 11. The brackets (not shown) adjacent the control knob 13 pivot freely about a bias on the mounting plate 31 while the opposite bracket 30 is associated with a further control knob or lever on the outside of the side rails 11** such that it can be pivotal for indexed movement between a normal position, as illustrated and opposed inclined positions.

For this purpose a sleeve on the bracket 30 extends through an aperture in the plate 31 and the side rails 11. The inner end of the sleeve supports the bar 24 while the outer end supports the tilting control. Suitable indexing means may be provided and locking nut may be threaded about the sleeve to hold the brackets 30 in their selected inclination to selectively position the bearing pad 16*a*.

Figure 6:
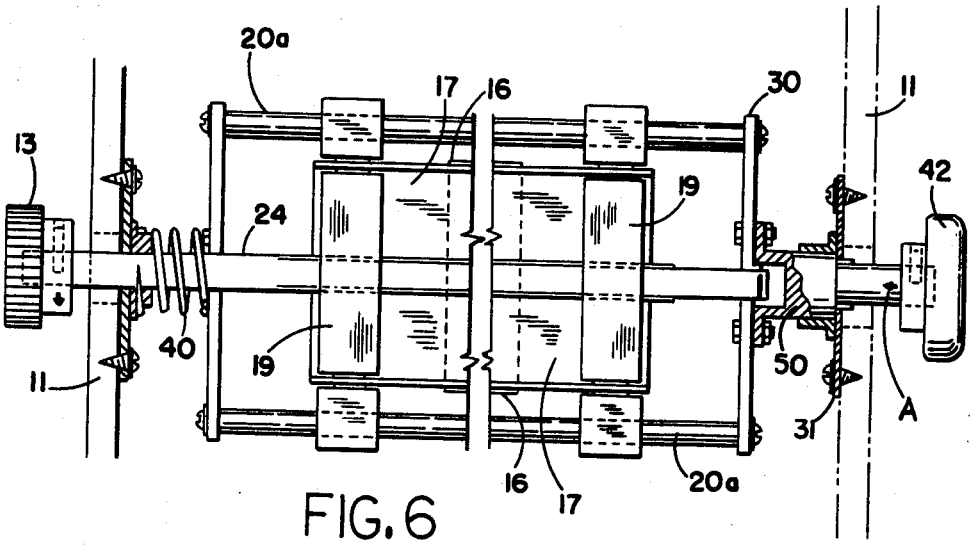
FIG. 6 illustrates another modified mounting arrangement for the support mechanism.
Figure 7:
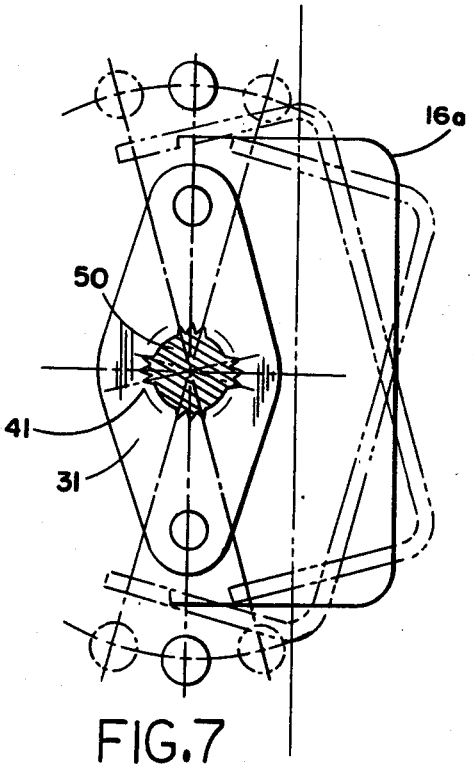
FIG. 7 shows a view illustrating the mode of adjustment of the mechanism of FIG. 6.

In the embodiment of FIGS. 6 and 7 the sleeve 50 which can be seen to form an axial extension of shaft 24 is spring biased by spring 40 to the right and is formed at a reduced diameter portion thereof with radial projections 41. Each projection engages in a selected one of a plurality of notches provided in the adjacent mounting plate 31. The outer end of the sleeve 50 has an operating knob 42 which may be manipulated by pressing it in the direction of the arrow A to cause it to compress the spring. This action disengages the radial projection from the notch. This action will enable relative rotation between side brackets 30 and plate 31. When the knob is released the projection may be located in a different one of the notches. In this fashion the angle at which the bearing pad projects out of the plane of the backrest may be varied. In an alternative arrangement (not illustrated) a spline connection maybe provided between the sleeve and the plate 31. By depressing the sleeve in the manner mentioned above the sleeve may be rotated and relocated in the plate 31 at a different angular position. In this way the angle at which the bearing pad projects from the backrest may be adjusted.

In an alternate form the control knob actuates a cam member which upon rotation bears against the back face of the bearing pad in a camming action to control its position. Also adjustable mounting means may be provided to move the bearing pad in an up and down position to suit a user. Furthermore, the bearing pad could be supported by a scissors type linkage or any suitable mechanical or electrical linkage or otherwise as desired. The shaft 24 could be electrically driven and provided with remote control means.

The claims defining the invention are as follows:

I claim:

1. A back support mechanism for a backrest of a chair mountable between two spaced side rails of a chair, said mechanism including:

adjustable support means including laterally disposed link members, each said link member having an upper and a lower arm, said support means further including two guide posts, said arms of each said link member engaging with a respective said guide post at spaced locations therealong, said arms being formed on an end portion of each said link member, each said link member having meshing projections formed thereon and spaced from said arms such that said meshing projections of said link members engage during operation of the mechanism;

a bearing pad means pivotally secured to said link members adjacent said meshing projections and bridging between said link members;

a pair of spaced guide rails extending between the side rails of the chair, said guide posts being mounted for movement along the guide rails; and, control means including a screw threaded shaft engaging said guide posts such that rotation of said shaft in one direction causes said guide posts to move towards one another and thereby cause the meshing projections to mesh and move the bearing pad means to an extended position and rotation of said shaft in a direction opposite to said one direction causes said meshing projections to mesh and said bearing pad means to move to a retracted position.

2. The mechanism of claim 1, wherein said shaft has screw threaded portions of opposite hand at respective end portions thereof, and each said screw threaded portion engages with a respective said guide post to move the posts along the guide rails and thereby move the bearing pad means between the extended and the retracted positions.

3. The mechanism of claims 1 or 2, including tilting means for varying the angle at which the bearing pad means moves out of the plane of the backrest.

4. The mechanism of claim 3, including biasing means for biasing the shaft in one axial direction and wherein said tilting means includes projections extending outwardly at one end of the shaft and notches formed in a mounting means for said tilting means such that the shaft may be moved axially against the biasing means to disengage the projections from the notches to permit rotation of said support means and thereafter in said one axial direction to re-engage the projections with the notches to enable the support means to project out of the plane of the backrest at a preselected angle.

5. The mechanism of claims 1 or 2, including a control knob at both ends of the shaft whereby said shaft may be rotated to operate the link members.

6. The mechanism of claims 1 or 2, including a backrest panel mounted to said bearing pad means.

7. The mechanism of claim 1, wherein said arms of each said link member are slotted and a respective said guide post is received in the slots in said arms of a respective said link member.

8. A chair in combination with the mechanism of claim 1.

* * * * *